US009731413B1

(12) United States Patent
Huner

(10) Patent No.: US 9,731,413 B1
(45) Date of Patent: Aug. 15, 2017

(54) OVERSTRIKE PROTECTOR

(71) Applicant: M.J. Huner LLC, Chicago, IL (US)

(72) Inventor: Mitchell Huner, Chicago, IL (US)

(73) Assignee: M.J. Huner LLC, Chicago, IL (US)

( * ) Notice: Subject to any disclaimer, the term of this patent is extended or adjusted under 35 U.S.C. 154(b) by 80 days.

(21) Appl. No.: 15/016,240

(22) Filed: Feb. 4, 2016

(51) Int. Cl.
*B26B 23/00* (2006.01)
*B25G 3/10* (2006.01)
*B25D 1/00* (2006.01)

(52) U.S. Cl.
CPC ..... *B25G 3/10* (2013.01); *B25D 1/00* (2013.01); *B26B 23/00* (2013.01)

(58) Field of Classification Search
CPC ..... B25G 3/10; B26B 23/00; B25D 1/00
USPC ..... 30/308.1
See application file for complete search history.

(56) References Cited

U.S. PATENT DOCUMENTS 2,850,331 A * 9/1958 Curry ..... B25G 3/34 403/179
2,980,154 A * 4/1961 Williamson ..... B25D 1/00 81/20
3,578,825 A * 5/1971 Merrow ..... B25D 1/00 403/252
3,792,725 A * 2/1974 Burgeson ..... B25G 3/34 473/310
4,172,483 A * 10/1979 Bereskin ..... B25D 1/00 81/20
4,334,563 A * 6/1982 Epel ..... B25D 1/12 30/308.1
4,352,381 A * 10/1982 Provi ..... B25G 1/00 30/308.1
5,259,274 A * 11/1993 Hreha ..... B25G 3/34 81/20
6,202,511 B1 * 3/2001 Murray ..... B25G 1/01 81/20
8,888,666 B2 * 11/2014 Quader ..... A63B 21/08 482/109
2003/0088964 A1 * 5/2003 Coonrad ..... B25D 1/00 29/428
2011/0088170 A1 * 4/2011 Crookston ..... B25D 1/04 7/122
2014/0000116 A1 * 1/2014 Brobeil ..... B25G 1/00 30/308.1
2015/0251302 A1 * 9/2015 Flosi ..... B25D 1/02 81/25
2015/0251303 A1 * 9/2015 Flosi ..... B25D 1/02 81/22

(Continued)

FOREIGN PATENT DOCUMENTS

EP 0 615 819 A1 * 9/1994

*Primary Examiner* — Hwei C Payer
(74) *Attorney, Agent, or Firm* — AU LLC; Adam E. Urbanczyk

(57) ABSTRACT

An apparatus for protecting a tool from an overstrike event. The apparatus generally includes a handle, a tool head, and a collar configuration with two or more collar members adapted to separably surround the handle. The collar members are affixed to the outer surface of the handle by a first adhesive. The tool head is placed over the handle and collar members and is affixed to the outer surfaces of the collar members with a second adhesive. The tool head secures the collar members which protect the handle around its circumference in the event of an overstrike event in any direction.

16 Claims, 7 Drawing Sheets

(56) References Cited

U.S. PATENT DOCUMENTS

2016/0008966 A1* 1/2016 Stokes ..... B25G 1/01
81/22

* cited by examiner

OVERSTRIKE PROTECTOR

BACKGROUND OF THE INVENTION

Field of the Invention

The present invention relates to tools, typically but not necessarily operated by the human hand, the operation of which involves striking or swinging motions which expose the tools to impacts.

Description of Relevant Prior Art

Tools used to strike objects, and features which protect those tools when in use despite their intended functions, are well known. Prototypical striking tools combine a striking mass in the form of a tool head and a handle, attached to the head, with which an operator may control and increase the acceleration of the tool head from a certain distance. This prototypical design, and typical method of use particularly where tool head mass is substantial, creates ample opportunities for the tool to be damaged, e.g., during an overstrike. During an overstrike, the tool head will not impact the target but instead narrowly, yet almost completely, miss the target leaving a portion of the tool handle, immediately proximate to the tool head, to impact the target and suffer greatly increased stress. Over time, a repeatedly-overstruck tool may catastrophically fail turning the tool head into a dangerous projectile. A number of devices have been proposed to help avoid these problems.

One such device is depicted in U.S. Pat. No. 279,582 entitled "Ax and Tool Handle Guard." Depicted there is a tool collar in the form of a metal sleeve adapted to wrap around a handle near the tool's head. The handle sleeve secures against itself through a set of tongues which engage rivets on the sleeve's surface. Also depicted is a U-shaped collar that wraps around the handle between the sleeve and the tool head, the collar being secured against the handle by a set of teeth. The U-shaped collar prevents the tool head from sliding down the handle when in use and the sleeve, as disclosed, protects the handle "from being split or splintered."

Another device is depicted in U.S. Pat. No. 661,523 entitled "Protector for Tool Handles." Depicted there is a shield fitted to one side of a handle, affording limited handle protection. One end of the shield fits between the tool head and the handle and the other end of the shield with an attaching strip.

Another device is depicted in U.S. Pat. No. 1,310,312 entitled "Ax Handle Guard." Depicted there is a one-piece, sheet metal guard bent to fit around just the front-facing and side surfaces of the handle of an axe near the axe head. The guard covers the handle from below the axe head and up in between the handle and the inner portion of the axe head. The guard is secured to the handle by rivets which extend from one side portion of the guard, through the handle itself, and into the other side portion of the guard.

Yet another device is depicted in U.S. Pat. No. 5,735,630 entitled "Striking Tool Head System and Common Elongated handle for Multiple Tool Head Assemblies." Depicted there is a tool handle adapted to accept multiple tool head types, those tool heads being secured against the handle with a one-piece sleeve fitting around the entirety of the handle. The sleeve creates a tapered ledge which frictionally mates with the tapered inner surfaces of the tool heads. The tool heads are prevented from advancing off the top end of the handle as a result of the tool head inner surfaces' top apertures having larger diameters than the bottom apertures, and overstrike protection is provided by the portion of the sleeve that exists below the tool head.

The litany of prior art tool devices which have features designed to secure a head onto a handle, protect the portion of the handle that meets the head, or both are only partially successful as they are limited to utilizing friction to secure the head onto the handle, do not protect the full circumference of the handle, or fail to adequately distribute overstrike impact along the length of the handle. A need exists for an improved apparatus and method for securing a head to a tool handle that also provides overstrike protection.

SUMMARY OF THE INVENTION

The present invention first comprises a handle having an outer surface. The handle has a first end and a second end, the outer surface of the first end being covered by a first adhesive means. A configuration of collar members is applied uniformly to the first adhesive means and around the first end. A second adhesive means covers the configuration of collar members. A tool head, having an aperture, is generally placed over the second adhesive means, collar configuration, and first end.

In one embodiment, the apparatus includes a handle with a radially variable cross section. The handle has a first end and a second end, the first end having a first adhesive means applied to its outer surface. A pair of collar members, each shaped to conform to the outer surface of the first end, is placed together onto the adhesive means nearly enclosing the first end, the collar members being separated by a gap on either side of the handle. A second adhesive means is applied to the outer surface of top portions of the collar members. A tool head contains an aperture that corresponds to handle's first end as it is covered by the top portions of the collar members. The tool head slides into place and is fixed onto the top portions of the collar members by the second adhesive means. The collar members are secured between the handle and tool head by the first and second adhesive means, respectively, though the collar members extend beneath the bottom of the tool head along the handle to protect that portion of the handle susceptible to overstrike impact.

In yet another embodiment, the present invention is directed to a method of securing a head to a tool handle. The head includes an aperture the inner surface of which is adapted to accept an adhesive means and an end of the tool handle, the end of the tool handle being at least partially enclosed by a configuration of collar members, the configuration of collar members being adhered to the tool handle by another adhesive means.

BRIEF DESCRIPTION OF THE DRAWINGS

The accompanying figures and drawings, incorporated into and forming part of the specification, service to further illustrate the present invention, its various principles and advantages, and varying embodiments. It is to be noted, however, that the accompanying figures illustrate only typical embodiments of the present invention and are not to be considered limiting of its scope as the present invention may admit other equally effective embodiments.

DETAILED DESCRIPTION OF THE INVENTION

Figure 1:
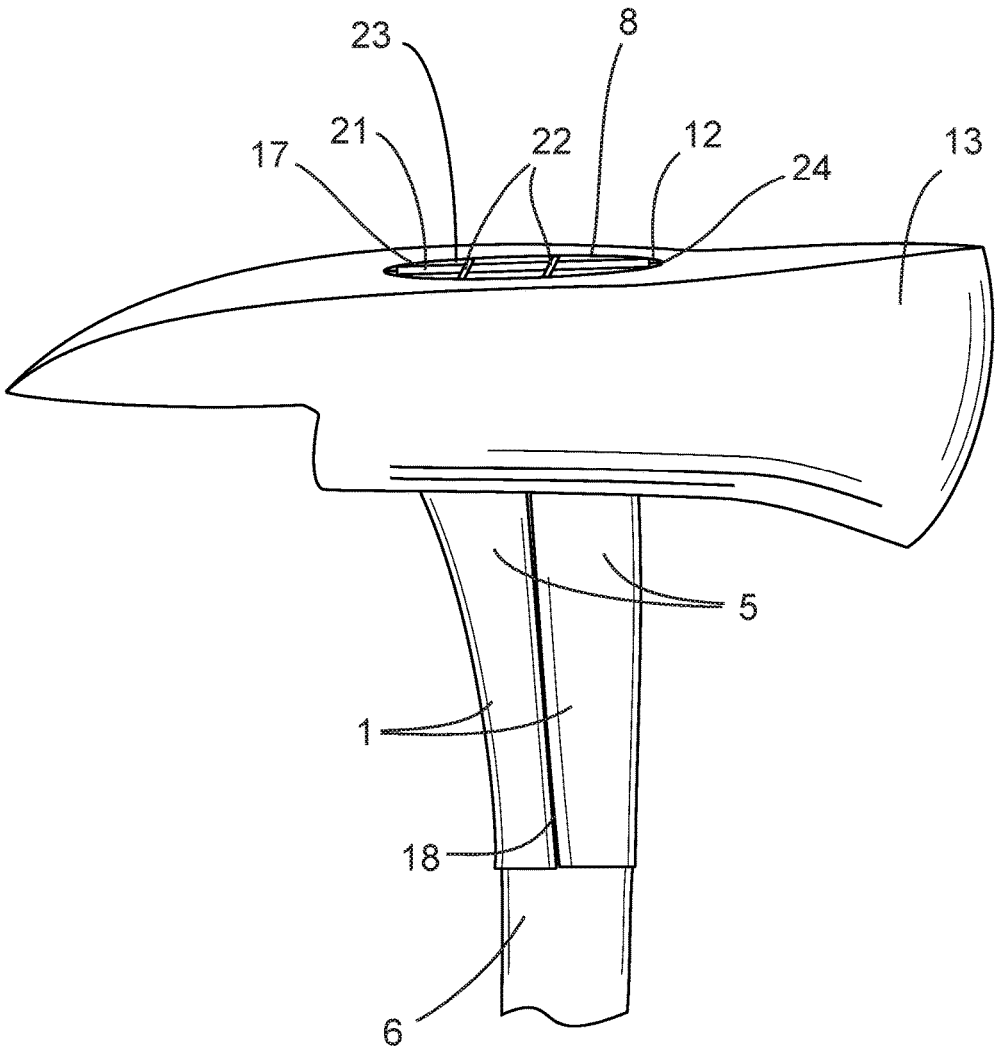
FIG. 1 depicts a perspective view of an assembled tool showing the assembled tool with a handle protected by two collar members and supporting an axe-type head.

FIG. 1 shows a perspective view of an assembled tool. A longitudinally variable handle 6 having a single-bit cross sectional profile 8 is covered on its top portion by a pair of collar members 1. The paired collar members 1 have lower outer surface 5 which exist beneath the axe tool head 13. The paired collar members 1 are separated by a collar member gap 18. A slot 12 is cut into a top portion 23 of the handle 6 into which a wooden wedge 21 is inserted. Two metal edges 22 are embedded into the top portion 23 of the handle 6. The lower outer surfaces 5 of the paired collar members 1 provide overstrike protection for the axe head 13 as it might be used impacting a target with either end of the axe head. The collar member gap 18 allows each lower outer surface 5 to move, during an impact event, independent of the other lower outer surface, preventing buckling or other structural deterioration of the collar members 1. Those skilled in the art will understand that a collar member gap 18 length, measured across the handle 6 will preferably be at least 0.125". A slot 12 is cut into the top of the handle 6 to accept a wood wedge 21 to enable the tool operator to further secure the handle 6 against the axe head 13 as the wood wedges 21, and metal wedges 22, when fully inserted into the slot 12 and top portion of the handle, respectively, cause the diameter of the top portion 23 of the handle 6 to increase and press against the inner surface of the axe head inner surface 17 within an aperture 24.

Figure 2:
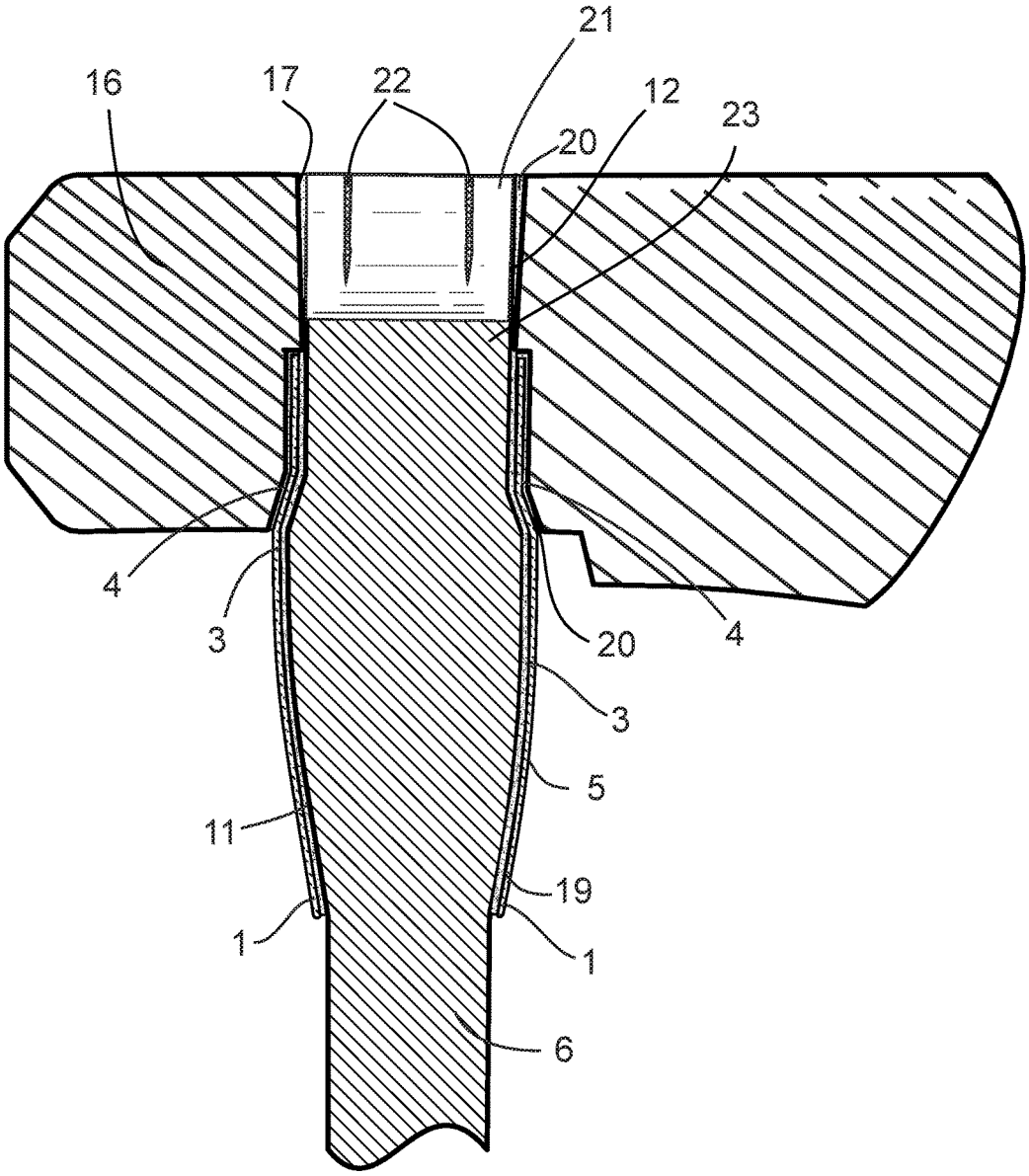
FIG. 2 depicts a vertical cross sectional view of an assembled tool showing the assembled tool with a handle supporting a combination maul-axe head.

FIG. 2 shows a vertical cross sectional view of an assembled tool. A first adhesive means 19 is disposed between the outer surface 11 of a longitudinally variable handle 6 and an inner surface 3 of collar members 1. A second adhesive means 20 is disposed between the upper outer surfaces 4 of the collar members 1 and the inner surface 17 of the combination tool head 16, as well as between the inner surface 17 and the top portion 23 of the handle 6. The lower outer surface 5 of the collar members 1 remain exposed and in the position to distribute the impact of an overstrike along the entire length of the handle 6 to which the collar members 1 is attached by the first adhesive means 19. A wood wedge 21 rests within a slot 12 on a top portion 23 of the handle 6. Metal wedges 22 are embedded into the handle top portion 23. The wood wedge 21 and metal wedges 22, as they are embedded into the slot 12 and top portion 23, respectively, increase the diameter of the handle top portion 23 to press it against the inner surface 17 of the combination tool head 16. The tool head 16 is thus held in place by an adhesive means in addition to the friction between the tool head inner surface 17 and the handle top portion 23, improving tool performance.

Figure 3:
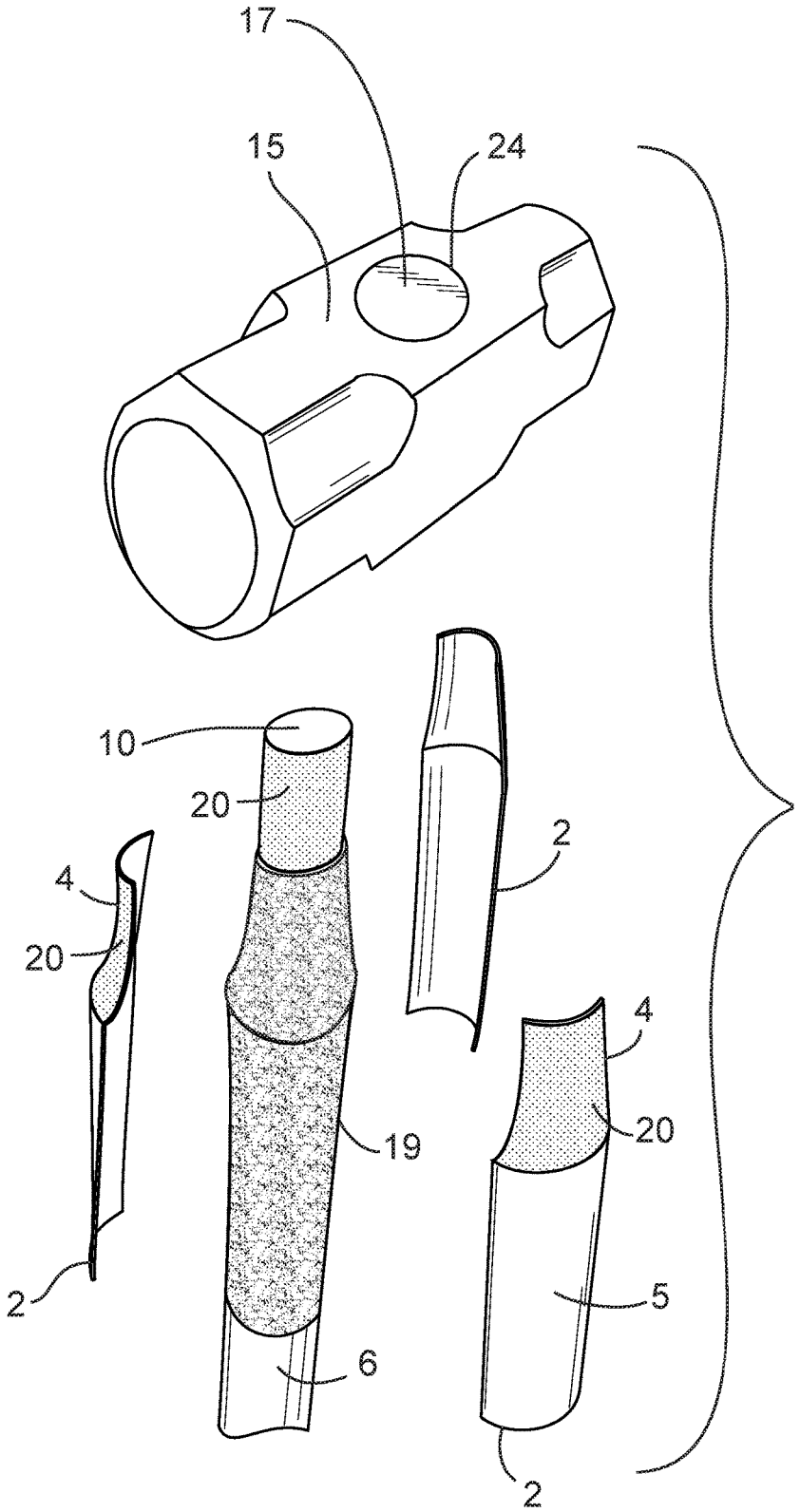
FIG. 3 depicts an exploded perspective view of a tool showing the tool with a handle supporting a maul-type head.

FIG. 3 shows an exploded perspective view of the present invention in a sledge-type embodiment. A longitudinally variable handle 6 has a radially uniform cross section 10. Three collar members 2 are arranged radially equidistant around the handle 6. A maul-type head 15 has an aperture 24 extending therethrough with an inner surface 17. A first adhesive means 19 is disposed onto the handle 6 and a second adhesive means 20 is disposed onto upper outer surfaces 4 of the collar members 2. When assembled, the collar members 2 will collapse around and adhere to the handle 6 by action of the first adhesive means 19. The maul-type head 15 slides onto the handle 6 and over the upper outer surfaces 4 of the collar members 2 affixing thereto by action of the second adhesive means 20. The lower outer surface 5 of the collar members 2 remains exposed below the maul-type head 15 to protect the handle 6 in the event of an overstrike impact.

Figure 4:
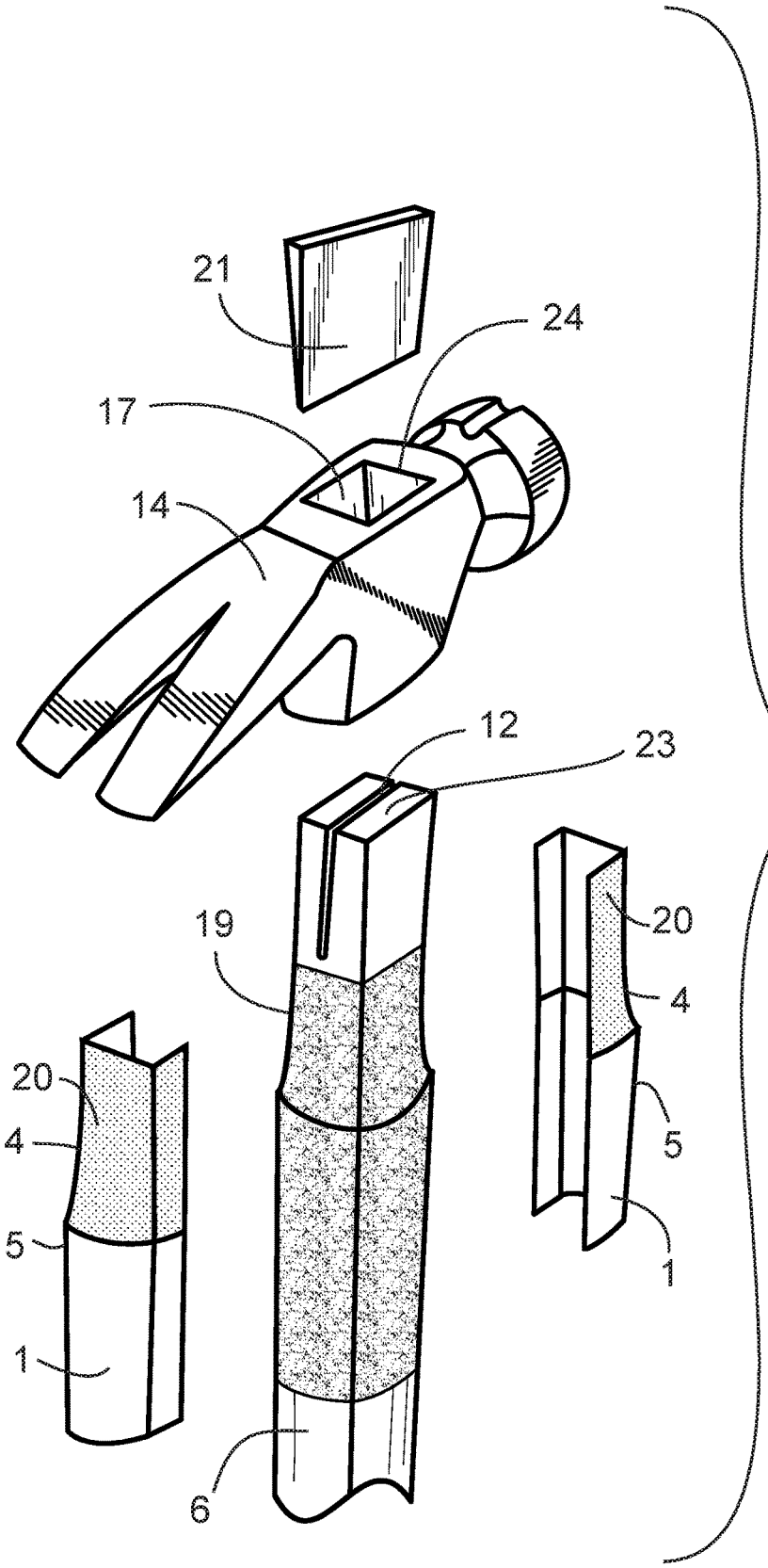
FIG. 4 depicts an exploded perspective view of a tool showing the tool with a handle supporting a hammer-type head.

FIG. 4 shows another exploded perspective view of the present invention, yet in a hammer-type embodiment. A longitudinally variable handle 6 has two collar members 1 arranged on opposite sides of the handle 6. A hammer-type head 14 has an aperture 24 extending therethrough with an inner surface 17. A first adhesive means 19 is disposed onto the handle 6 and a second adhesive means 20 is disposed onto upper outer surfaces 4 of the collar members 1. When assembled, the collar members 1 will collapse around and adhere to the handle 6 by action of the first adhesive means 19. The hammer-type head 14 slides onto the handle 6 and over the upper outer surfaces 4 of the collar members 1 affixing thereto by action of the second adhesive means 20. A wooden wedge 21 is embedded into a slot 12 on a top portion 23 of the handle 6, causing the top portion to press against the inner surface 17 of the aperture 24. The lower outer surface 5 of the collar members 1 remains exposed below the hammer-type head 14 to protect the handle 6 in the event of an overstrike impact.

Figure 5:
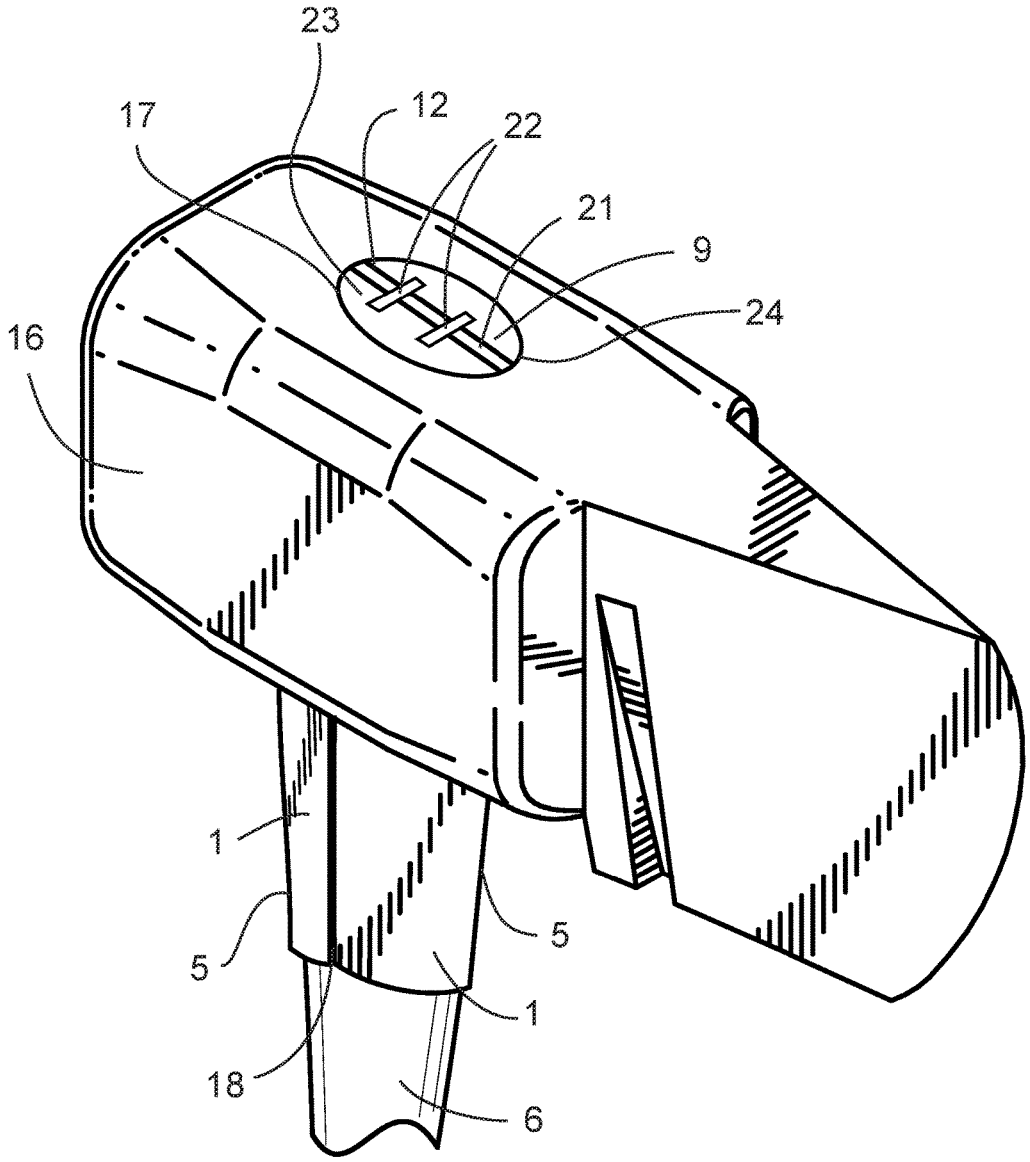
FIG. 5 depicts a perspective view of an assembled tool showing the assembled tool with a handle supporting a combination maul-axe head.

FIG. 5 shows another perspective view of the present invention, yet in a combination maul-axe tool type embodiment. A longitudinally variable handle 6 with a double-bit radially variable cross section 9 has two collar members 1 arranged on opposite sides of the handle 6 forming a collar member gap 18. The combination maul-axe head 16 fits over the handle 6 and collar members 1. A wooden wedge 21 and two metal wedges 22 are embedded into a slot 12 and top portion 23 of the handle 6, respectively, increasing the diameter of the handle top portion 23 to secure it against the inner surface 17 of the head aperture 24. The lower outer surface 5 of the collar members 1 remains exposed below the combination maul-axe type head 16 to protect the handle 6 in the event of an overstrike impact.

Figure 6:
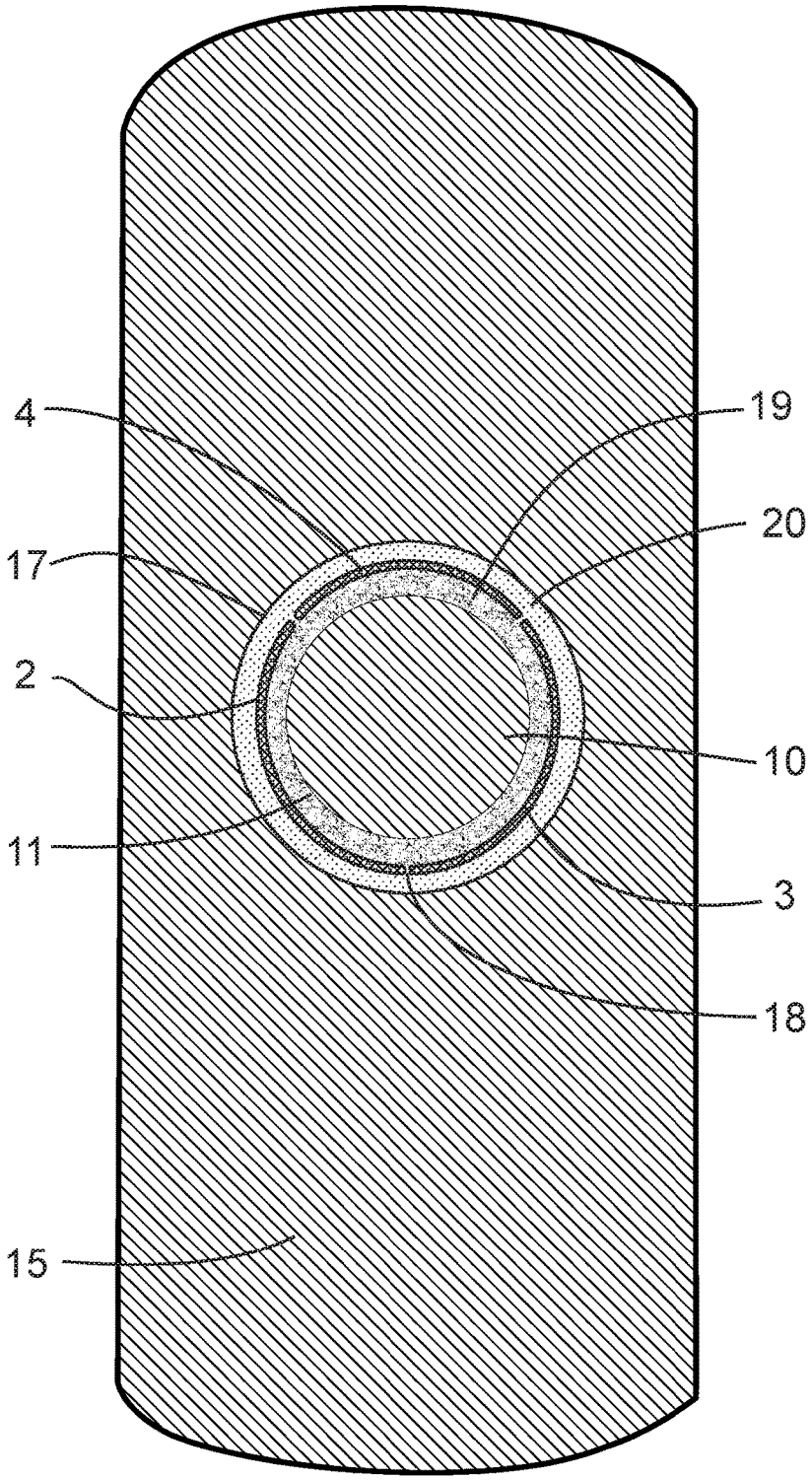
FIG. 6 depicts a top cross sectional view of an assembled tool showing the assembled tool head with a handle supporting a maul-type head.

FIG. 6 shows a cross sectional view of the present invention in a maul-type embodiment. A first adhesive means 19 is disposed between the outer surface 11 of a handle with a radially uniform cross section 10 and the inner surfaces 3 of three collar members 2 forming three collar member gaps 18. A second adhesive means 20 is disposed between the upper outer surfaces 4 of the collar members 2 and the inner surface 17 of the maul-type head 15.

Figure 7:
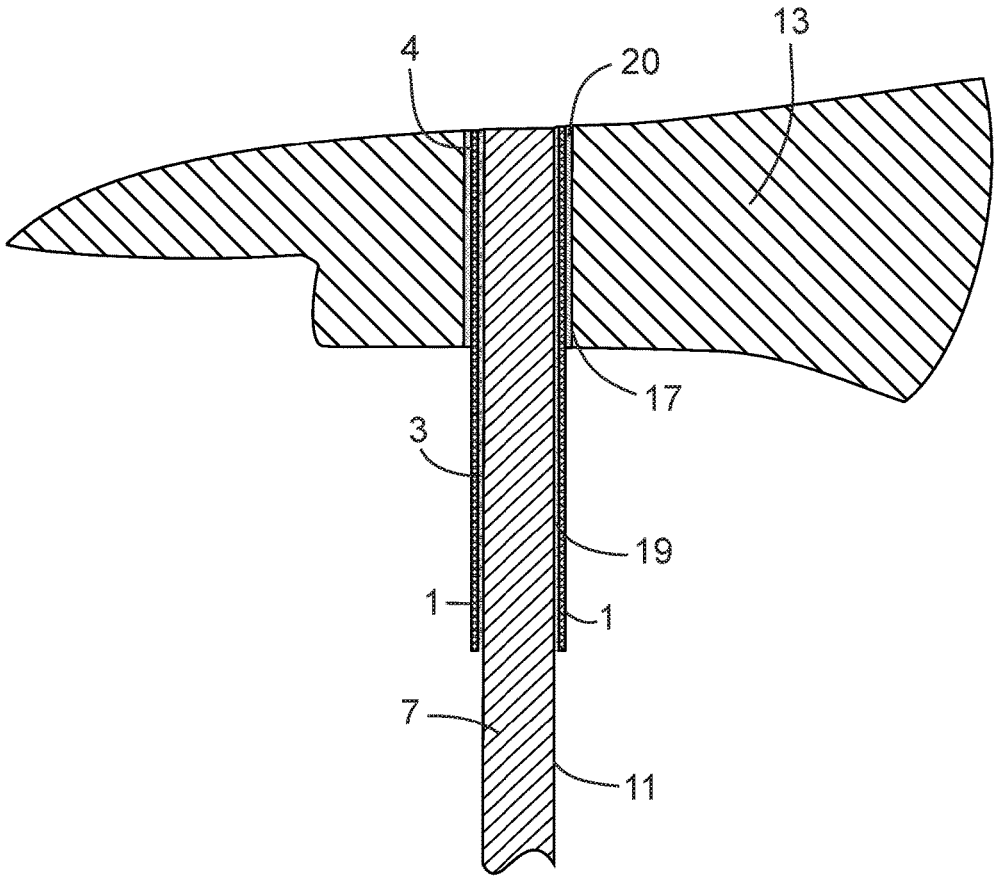
FIG. 7 depicts a vertical cross sectional view of an assembled tool showing the assembled tool with a handle supporting an axe-type head.

FIG. 7 shows a cross sectional view of the present invention, yet in a fire axe embodiment. A first adhesive means 19 is disposed between the outer surface 11 of a longitudinally uniform handle 7 and an inner surface 3 of a collar members 1. A second adhesive means 20 is disposed between the upper outer surfaces 4 of the collar members 1 and the inner surface 17 of the axe head 13.

The handle 6, 7 may be made from wood, fiberglass, high-impact plastic, metal, laminated carbon fiber, or other material commonly used for striking tools. The collar members 1, 2 may be made from tempered steel, high impact metal alloy, or other sufficiently durable material. The tool heads 13, 14, 15, 16 may be made from forged or tempered steel or hardened alloy of the type typically used for striking tool heads. The first 19 and second 20 adhesive means may be epoxy resins, bonding compounds, or other adhesives designed to bond wood, metal, fiberglass, high-impact plastic, and carbon fiber materials.

Although the above detailed descriptions relate to specific preferred embodiments as the inventor presently contemplates, it will be understood that the invention in its broad aspects includes mechanical, chemical, and functional equivalents of the elements described herein. Various details of design and construction may be modified without departing from the true spirit and scope of the invention which is set forth in the following claims. Other embodiments, which will be apparent to those skilled in the art and which practice the teachings herein set forth, are intended to be within the scope and spirit of the invention.

I claim:

1. A tool comprising:

a. a handle having an outer surface, the handle having a first end and a distal second end;

b. a plurality of collar members adapted to be placed against the outer surface, the collar members which when placed radially equidistant around and against the outer surface create a plurality of collar gaps, the collar gaps each existing between two adjacent ones of the collar members across the outer surface, the collar members each having a first surface and a second surface;

c. a first adhesive means, the first adhesive means being disposed between the outer surface and each of the first surfaces;

d. a head, the head having an aperture therethrough, the aperture having an inner surface adapted to fit over the first end and the plurality of collar members; and e. a second adhesive means, the second adhesive means being disposed between each of the second surfaces and the inner surface.

2. The tool according to claim 1, wherein the first end is adapted to receive at least one wedge, the at least one wedge when embedded into the first end causing the diameter of the first end to increase.

3. The tool according to claim 1, wherein the tool is a hammer.

4. The tool according to claim 1, wherein the tool is an axe.

5. The tool according to claim 1, wherein the tool is a maul.

6. The tool according to claim 2, wherein the tool is a hammer.

7. The tool according to claim 2, wherein the tool is an axe.

8. The tool according to claim 2, wherein the tool is a maul.

9. A method of attaching a head to a handle comprising:

a. placing a first adhesive means against and around an outer surface of a first end of a handle, the handle having a second end distal from the first end;

b. placing in radially equidistant spaced apart fashion a first surface of each of a plurality of collar members onto the first adhesive means, the plurality of collar members each having a second surface;

c. placing a second adhesive means against and around the second surfaces of the plurality of collar members; and d. placing a head around the first end, the head having an aperture therethrough, the aperture having an inner surface adapted to fit over the first end and the plurality of collar members.

10. The method in claim 9, further including embedding at least one wedge into the first end causing the diameter of the first end to increase.

11. The method in claim 9, further including providing a hammer as the head.

12. The method in claim 9, further including providing an axe as the head.

13. The method in claim 9, further including providing a maul as the head.

14. The method in claim 10, further including providing a hammer as the head.

15. The method in claim 10, further including providing an axe as the head.

16. The method in claim 10, further including providing a maul as the head.

* * * * *